US010279455B1

(12) United States Patent
Cooper

(10) Patent No.: US 10,279,455 B1
(45) Date of Patent: May 7, 2019

(54) PIPE CLAMP

(71) Applicant: Royce D. Cooper, Cleveland, TX (US)

(72) Inventor: Royce D. Cooper, Cleveland, TX (US)

( * ) Notice: Subject to any disclaimer, the term of this patent is extended or adjusted under 35 U.S.C. 154(b) by 0 days.

(21) Appl. No.: 16/044,552

(22) Filed: Jul. 25, 2018

Related U.S. Application Data

(60) Provisional application No. 62/536,512, filed on Jul. 25, 2017.

(51) Int. Cl.
*B25B 5/02* (2006.01)
*B25B 5/14* (2006.01)
*B25B 5/00* (2006.01)

(52) U.S. Cl.
CPC ..... *B25B 5/147* (2013.01); *B25B 5/003* (2013.01); *B25B 5/02* (2013.01)

(58) Field of Classification Search
None
See application file for complete search history.

(56) References Cited

U.S. PATENT DOCUMENTS

| | | | | |
|---|---|---|---|---|
| 2,923,334 | A * | 2/1960 | Brennan Jr. | B25B 5/102 269/147 |
| 3,575,405 | A | 4/1971 | Harding | |
| 5,058,870 | A * | 10/1991 | Cetnar | B25B 5/003 269/118 |
| D355,104 | S * | 2/1995 | Sorensen | D8/72 |
| 5,722,649 | A | 3/1998 | Morris | |
| 5,775,680 | A | 7/1998 | Sorensen et al. | |
| 6,050,559 | A | 4/2000 | de Souza | |
| 7,159,859 | B2 * | 1/2007 | Fuller | B25B 5/068 269/170 |
| 2007/0222130 | A1 | 9/2007 | Leinbach et al. | |

* cited by examiner

*Primary Examiner* — Joseph J Hail
*Assistant Examiner* — Brian D Keller
(74) *Attorney, Agent, or Firm* — Cramer Patent & Design, PLLC; Aaron R. Cramer

(57) ABSTRACT

A pipe clamp includes a length of tubing having a pair of polygonal clamps moveably secured about the tube through an aperture located at a proximal end of each clamp. At a distal end of the tubing projects a nut which is perpendicularly secured thereto. A rod is engaged within the nut and in mechanical communication with the distal exterior end of the closest clamp. A handle is secured to the distal end of the rod.

19 Claims, 4 Drawing Sheets

PIPE CLAMP

RELATED APPLICATIONS

The present invention was first described in and claims the benefit of U.S. Provisional Patent Application No. 62/536,512 filed on Jul. 25, 2017, the entire disclosures of which are incorporated herein by reference.

FIELD OF THE INVENTION

The present invention relates generally to the field of pipe clamps.

BACKGROUND OF THE INVENTION

As either professional tradespeople or do-it-yourself home-improvers will attest, nothing beats having the proper tool for a given job. The proper tool cannot only save time, money, and reduce damage to equipment and work supplies but also provide for the increased safety of the user.

One tool utilized in a wide range of applications is that of the pipe clamp. Its ability to clamp and hold objects in close and tight proximity while a given bonding agent is allowed to cure or a fastener is applied makes it ideal for use particularly in woodworking e.g., furniture making and cabinetry. Additionally, some clamps operate in reverse allowing them to be used to force objects apart—which is often required when repairing legs or table leaves on furniture without exposing the wood to the potentially damaging effects of an errant hammer blow or marring effects of overwrought nails or screws. However, the process for reversing the tension of a traditional pipe clamp is often complicated and takes much time to accomplish successfully if it is accomplished at all.

Many efforts have been made to address this problem such as U.S. Pat. No. 927,067 A, U.S. Pat. No. 7,159,859 B2, U.S. Pat. No. 307,439 A and US 20070222130 A1. However, these devices are unsatisfactory in both desired effect and ease of operation. Accordingly, there is a need for a means by a single pipe clamp may be selectively utilized to clamp objects together or spread them in tensioned opposition without the frustrations, and risky damages as described above. The device of the instant application accomplishes this task.

SUMMARY OF THE INVENTION

To achieve the above and other objectives, the present invention provides for A pipe clamp, comprising a first slide having a first end, a second slide having a first end, a first clamp, a second clamp, a handle, a slide supporting element, a slide supporting element retaining ring and a slide supporting element cap.

The slide supporting element is affixed to the first end of the first slide that is oriented rearwardly so that it slidably engages the second clamp and the first clamp. The first end of the second slide is affixed to the second clamp and is oriented forwardly, so that it slidably engages the slide supporting element. The second slide is oriented forwardly, so that it slidably engages the slide supporting element, the slide supporting element having a slide supporting element first end, a slide supporting element second end, and a slide supporting element third end opposite from and linearly aligned with the slide supporting first end. The slide supporting element second end is disposed between the slide supporting element first end and the slide supporting element third end and oriented perpendicularly from a common bisecting centerline through the slide supporting element first end and the slide supporting element third end.

The slide supporting element retaining ring is secured to an upper terminal apex of the slide supporting element first end. The slide supporting element retaining ring enables the second slide to movably pass therethrough. The first end of the first slide is removedly or fixedly attached to the slide supporting element second end. The first clamp is movably attached to the first slide, the first clamp includes a first clamp body oriented vertically and parallel to the slide supporting element first end and slide supporting element third end of the slide supporting element. A first clamp receiver is affixed to a first side and adjacent a bottom end of the first clamp body. A first clamp aperture traverses through the first clamp receiver and first clamp body, the first clamp has an acute angular shape that causes the first clamp to grasp the first slide in the region within the first clamp aperture when an upper portion of the first clamp is exposed to a first force in a first direction corresponding to the axis of the second slide or when a second force is exerted in a second direction corresponding to the axis of the second slide in opposite direction to the first direction. The first clamp is affixed also to the first side of a sleeve of a semi-circular cross-section that is centrally located on the first clamp body and is discontinuously coextensive with a height thereof. There is a break in the sleeve as the first clamp receiver and first clamp aperture traverses it, a stop is affixed to an upper side of the first clamp receiver.

The second clamp includes a second clamp body, a second clamp bore passing within a first side of the second clamp body, and a second clamp aperture passing through a lower section of the second clamp body. A first end of the second slide is fixedly or removably secured within the second clamp bore, the second clamp is moveably secured about the first slide through the second clamp aperture, the first clamp aperture, second clamp aperture, and slide supporting element second end are coaligned along a common bisecting axial centerline. The second clamp bore and the slide supporting element retaining ring are coaligned along a common bisecting axial centerline. The second clamp and the second slide move in conjunction with each other, in a third direction or a fourth direction. The handle is perpendicularly secured to a second end of the second slide with an encircling handle sleeve, either removably or fixedly thereto. The slide supporting element cap is secured about the slide supporting element third end.

The first slide and the second slide may have a tubular construction that is cylindrical while the first slide may have a larger diameter and a larger length than the second slide. The second clamp may have a cuboidal-shape while the slide supporting element may generally be T-shaped. The first clamp body has a predominately rectangular shape while the stop may also have generally a rectangular planar construction.

The first clamp receiver may have a width smaller than the diameter of the first clamp receiver and a height less than the height of the first clamp body while the second clamp may be cuboidal-shaped. The second clamp body may have a height which is substantially identical to the height of the first clamp. The second clamp bore may terminate at a distance less than the thickness thereof while the slide supporting element cap may be removably secured about the slide supporting element third end. The slide supporting element cap may be fixedly secured about the slide supporting element third end.

The first slide, the second slide, the first clamp, the second clamp, the slide supporting element, the slide retaining element second slide retaining ring, the handle, and the handle sleeve may be made of metal or a rigid plastic. Each pipe clamp may clamp a plurality of independent pieces by placing the independent pieces between the first clamp and the second clamp. The second clamp may be forced in the third direction until snug. The pipe clamp may spread the independent pieces by placing a first independent piece outside of the first clamp and a second independent piece on the outside of the second clamp. The pipe clamp may also act by pulling the second slide in a fourth direction until the independent pieces of the project are appropriately biased apart. The pipe clamp may apply a force to hold a plurality of objects together and may force the objects apart from each other.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
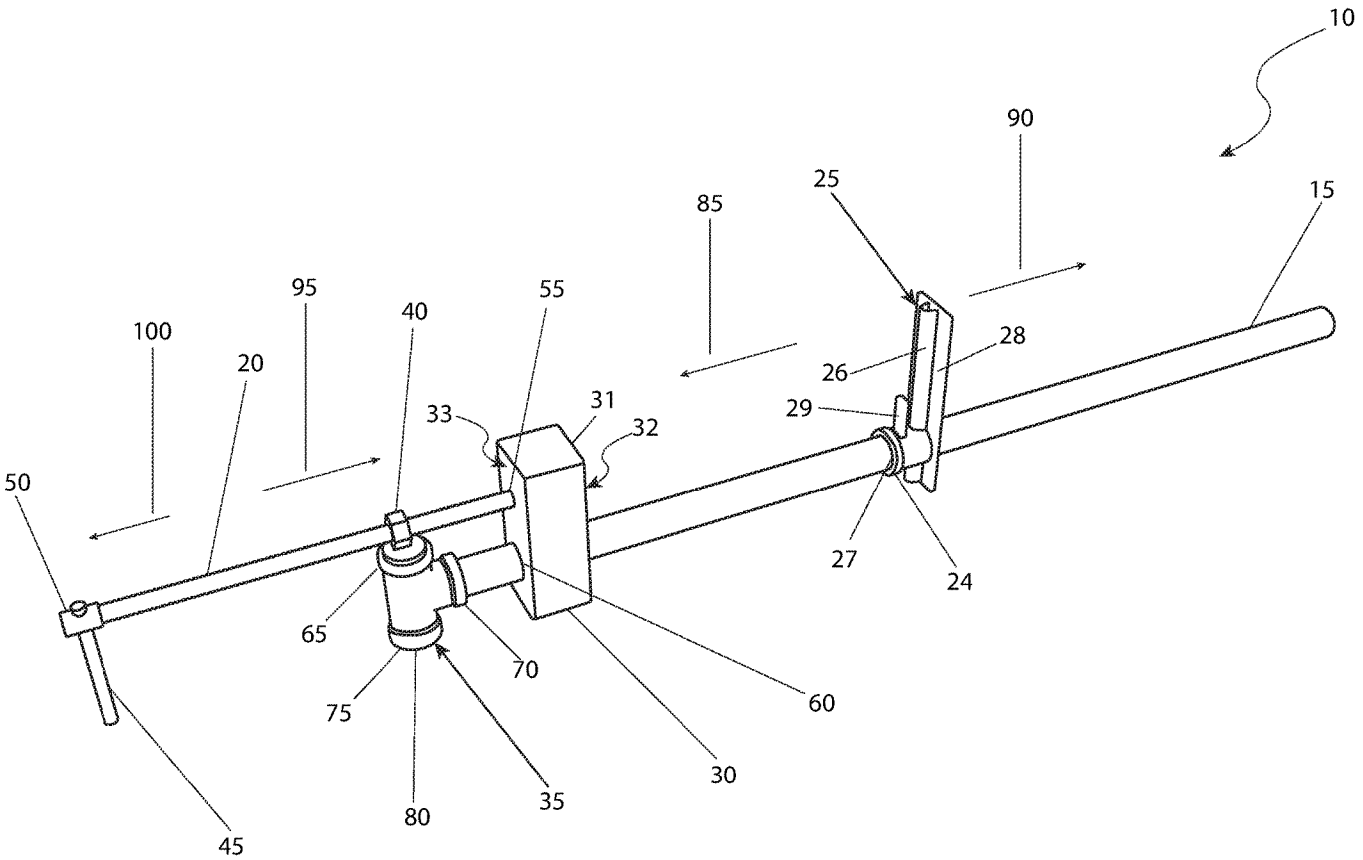
FIG. 1 is a perspective view of a pipe clamp 10 according to a preferred embodiment of the present invention.

10 pipe clamp
15 first slide
20 second slide
24 first clamp receiver
25 first clamp
26 sleeve
27 first clamp aperture
28 first clamp body
29 stop
30 second clamp
31 second clamp body
32 second clamp body clamping face
33 second clamp body separating face
35 slide supporting element
40 slide supporting element retaining ring
45 handle
50 handle sleeve
55 second clamp bore
60 second clamp aperture
65 slide supporting element first end
70 slide supporting element second end
75 slide supporting element third end
80 slide supporting element cap
85 first direction
90 second direction
95 third direction
100 fourth direction

DETAILED DESCRIPTION OF THE PREFERRED EMBODIMENT

Figure 2:
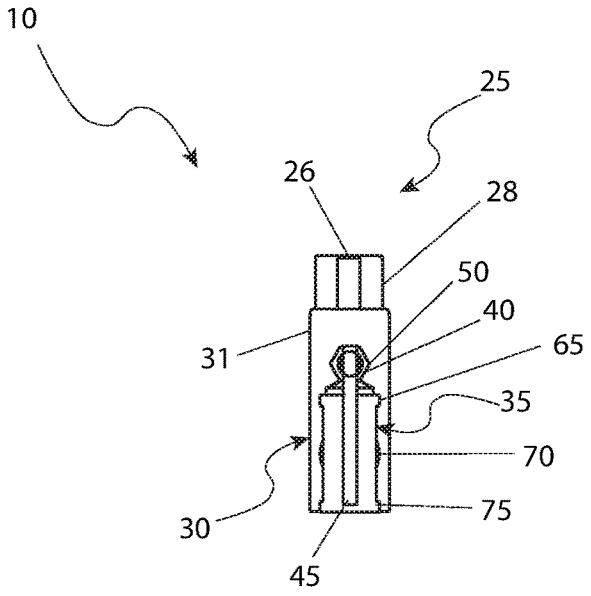
FIG. 2 is a front elevation view of the pipe clamp 10 according to a preferred embodiment of the present invention.
Figure 3:
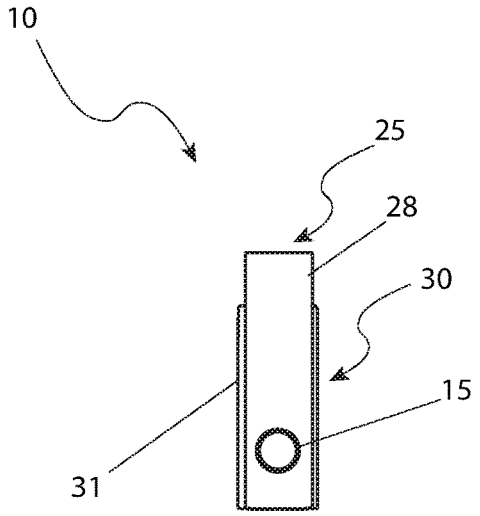
FIG. 3 is a rear elevation view of the pipe clamp 10 according to a preferred embodiment of the present invention.
Figure 4:
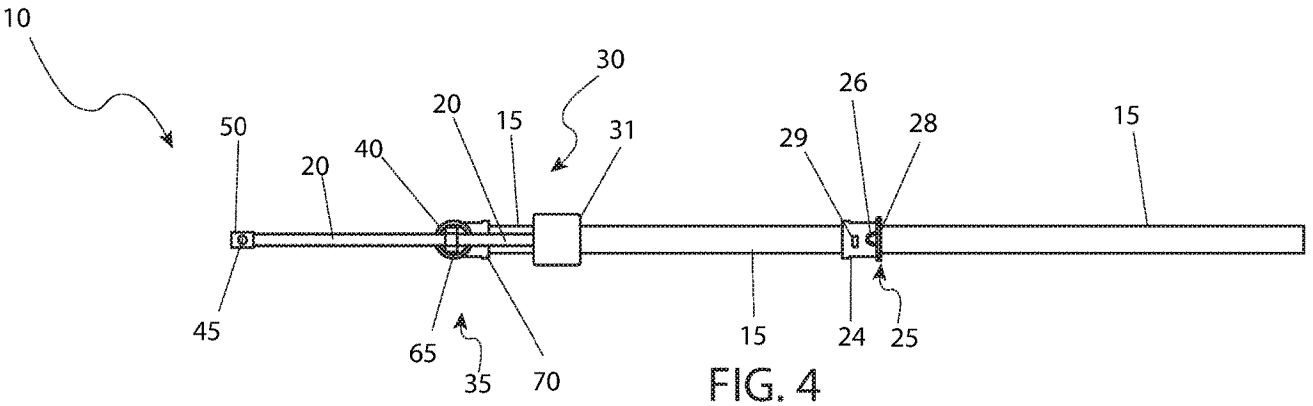
FIG. 4 is a top plan view of the pipe clamp 10 according to a preferred embodiment of the present invention.
Figure 5:
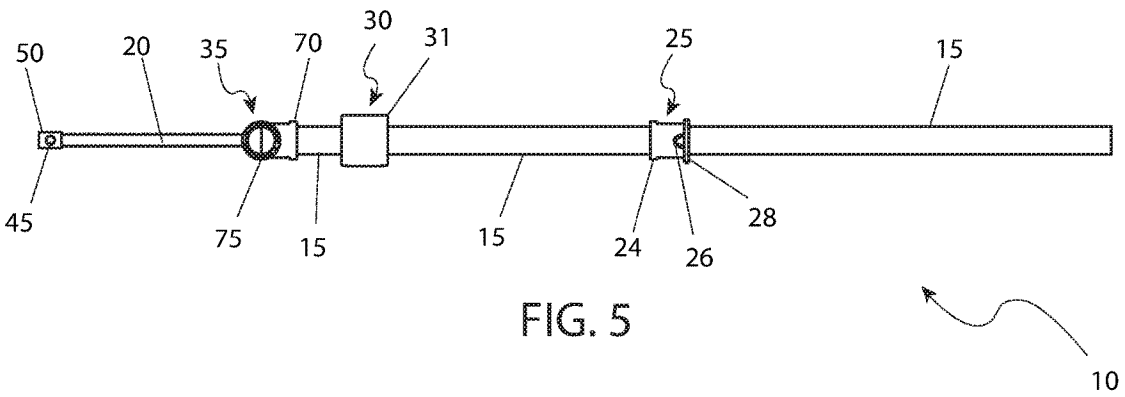
FIG. 5 is a bottom plan view of the pipe clamp 10 according to a preferred embodiment of the present invention.
Figure 6:
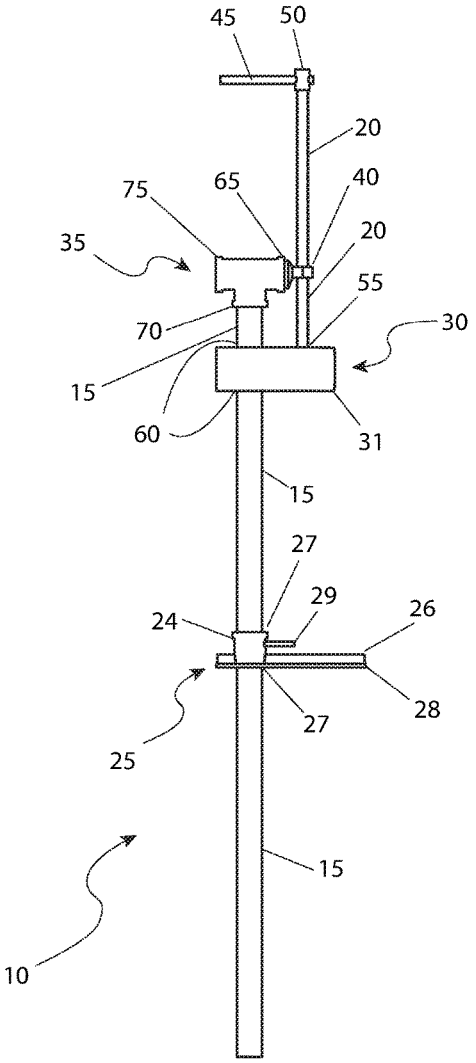
FIG. 6 is a first side elevation view of the pipe clamp 10 according to a preferred embodiment of the present invention; and, FIG. 7 is a second side elevation view of the pipe clamp 10 according to a preferred embodiment of the present invention.
Figure 7:
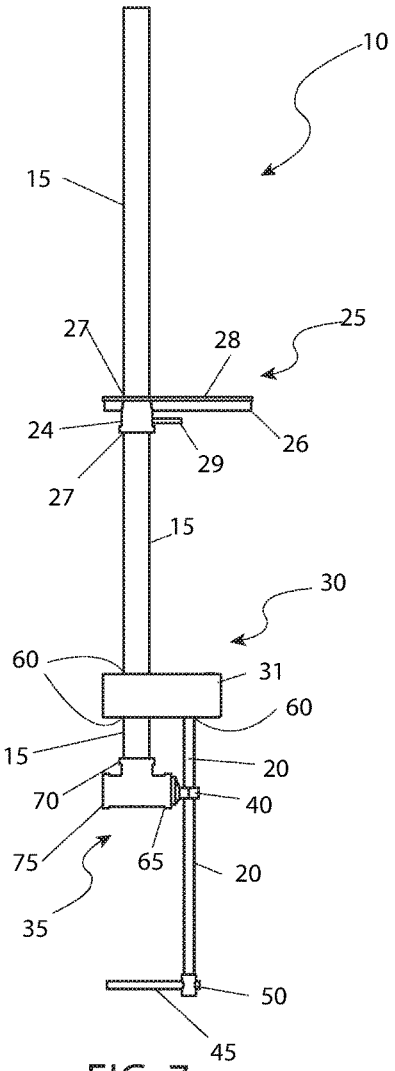

The best mode for carrying out the invention is presented in terms of its preferred embodiment, herein depicted within FIGS. 1 through 7. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

1. DETAILED DESCRIPTION OF THE FIGURES

Referring now to FIGS. 1 through 7, various views of a pipe clamp (herein described as the "device") 10 according to a preferred embodiment of the present invention is disclosed. The device 10 comprises a first slide 15, a second slide 20, a first clamp 25, a second clamp 30, a handle 45, and a slide supporting element 35. A first end of the first slide 15 is affixed to the slide supporting element 35 and is oriented rearwardly, such that it slidably engages the second clamp 30 and the first clamp 25. A first end of the second slide 20 is affixed to the second clamp 30 and is oriented forwardly, such that it slidably engages the slide supporting element 35. Each of the first slide 15 and second slide 20 comprises a tubular construction that is preferably cylindrical in shape, with the first slide 15 being of a larger diameter and a larger length that the second slide 20.

The slide supporting element 35 is generally "T"-shaped and comprises a slide supporting element first end 65, a slide supporting element second end 70, and a slide supporting element third end 75 opposite from and linearly aligned with the slide supporting first end 65. The slide supporting element second end 70 is disposed between the slide supporting element first end 65 and the slide supporting element third end 75 and oriented perpendicularly from a common bisecting centerline through the slide supporting element first end 65 and the slide supporting element third end 75. A slide supporting element retaining ring 40 is secured to the upper terminal apex of the slide supporting element first end 65. The slide supporting element retaining ring 40 enables the second slide 20 to movably pass therethrough. The first end of the first slide 15 is removedly or fixedly attached to the slide supporting element second end 70.

A first clamp 25 is movably attached to the first slide 15. The first clamp 25 includes a first clamp body 28 having a predominately rectangular shape and oriented vertically and parallel to the slide supporting element first end 65 and slide supporting element third end 75 of the slide supporting element 35. Affixed to a first side and adjacent a bottom end of the first clamp body 28 is a first clamp receiver 24. A first clamp aperture 27 traverses through the first clamp receiver 24 and first clamp body 28. The first clamp 25 has an acute angular shape that causes the first clamp 25 to grasp the first slide 15 in the region within the first clamp aperture 27 when an upper portion of the first clamp 25 is exposed to a first force in a first direction 85 corresponding to the axis of the second slide 20 or when a second force is exerted in a second direction 90 corresponding to the axis of the second slide 20 in opposite direction to the first direction 85. Affixed also to the first side of the first clamp body is a sleeve 26 of a semi-circular cross-section that is centrally located on the first clamp body 28 and is discontinuously coextensive with the height thereof. There is a break in the sleeve 26 as the first clamp receiver 24 and first clamp aperture 27 traverses it. Affixed to an upper side of the first clamp receiver 24 is a stop 29, which is generally a rectangular planar construction having a width smaller than the diameter of the first clamp receiver 24 and a height less than the height of the first clamp body 28.

A cuboidal-shaped second clamp 30 includes a second clamp body 31 having a second clamp body clamping face 32 and a second clamp body separating face 33. The second clamp body 31 having a height substantially identical to the height of the first clamp 25, a second clamp bore 55 passing within a first side of the second clamp body 31 and terminating at a distance less than the thickness thereof, and a second clamp aperture 60 passing through a lower section of the second clamp body 31. A first end of the second slide 20 is fixedly or removably secured within the second clamp bore 55. The second clamp body 31 is moveably secured about the first slide 15 through the second clamp aperture 60. The first clamp aperture 27, second clamp aperture 60, and slide supporting element second end 70 are coaligned along a common bisecting axial centerline. The second clamp bore 55 and slide supporting element retaining ring 40 are coaligned along a common bisecting axial centerline. As such, the second clamp 30 and second slide 20 moves in conjunction with each other, in the third direction 95 or fourth direction 100.

A handle 45 is perpendicularly secured to a second end of the second slide 20 with an encircling handle sleeve 50, either removably or fixedly thereto.

A slide supporting element cap 80 is capable of being removably or fixedly secured about the slide supporting element third end 75.

2. MANUFACTURE AND UTILIZATION OF THE PREFERRED EMBODIMENT

The preferred embodiment of the present invention can be utilized by the common user in a simple and effortless manner with little or no training. It is envisioned that the device 10 would be constructed in general accordance with FIG. 1 utilizing either metal or rigid plastic, in whole or in part, for the first slide 15, second slide 20, first clamp 25, second clamp 30, slide supporting element 35, slide retaining element second slide retaining ring 40, handle 45, and handle sleeve 50.

The device 10 is particularly suited for applying force to hold objects together or to force the objects apart from teach other. A user, upon procuring the device 10 would choose to either clamp independent pieces of a given project (not shown) by placing the pieces of a given project (not shown) between the first clamp 25 and the second clamp 30 utilizing the second clamp body clamping face 32 and forcing the second clamp 30 in a third direction 95 until appropriately snug. Conversely, a user could spread independent pieces of a given project (not shown) by placing a first independent piece (not shown) on the outside of the first clamp 25 and a second independent piece (not shown) on the outside of the second clamp 30 utilizing the second clamp body separating face 33 and pulling the second slide 20 in a fourth direction 100 until the independent pieces of a given project (not shown) are appropriately biased apart.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A pipe clamp, comprising:

a first slide having a first end;

a second slide having a first end;

a first clamp;

a second clamp;

a handle;

a slide supporting element affixed to said first end of said first slide that is oriented rearwardly capable of slidingly engaging said second clamp and said first clamp, said first end of said second slide is affixed to said second clamp and is oriented forwardly, capable of slidingly engaging said slide supporting element, said second slide is oriented forwardly, so that it slidably engages said slide supporting element, said slide supporting element having a slide supporting element first end, a slide supporting element second end, and a slide supporting element third end opposite from and linearly aligned with said slide supporting first end, said slide supporting element second end is disposed between said slide supporting element first end and said slide supporting element third end and oriented perpendicularly from a common bisecting centerline through said slide supporting element first end and said slide supporting element third end;

a slide supporting element retaining ring secured to an upper terminal apex of said slide supporting element first end, said slide supporting element retaining ring enables said second slide to movably pass therethrough, the first end of said first slide is removedly or fixedly attached to said slide supporting element second end, said first clamp movably attached to said first slide, said first clamp includes a first clamp body, a first clamp receiver is affixed to a first side of said first clamp body and adjacent a first end of said first clamp body, a first clamp aperture traverses through said first clamp receiver and first clamp body, said first clamp configured to grasp said first slide in a region within said first clamp aperture when an upper portion of said first clamp is exposed to a first force in a first direction corresponding to an axis of said second slide or when a second force is exerted in a second direction corresponding to said axis of said second slide in opposite direction to said first direction, said first clamp affixed also to a first side of a sleeve of a semi-circular cross-section that is centrally located on said first clamp body and said sleeve is discontinuously coextensive with a height of said first clamp body, wherein there is a break in said sleeve as said first clamp receiver and first clamp aperture traverses it said sleeve, said second clamp includes a second clamp body, a second clamp bore passing within a first side of said second clamp body, and a second clamp aperture passing through a lower section of said second clamp body, a first end of said second slide is fixedly or removably secured within said second clamp bore, said second clamp is moveably secured about said first slide through said second clamp aperture, said first clamp aperture, second clamp aperture, and said slide supporting element second end are coaligned along a common bisecting axial centerline, said second clamp bore and said slide supporting element retaining ring are coaligned along a common bisecting axial centerline, said second clamp and said second slide move in conjunction with each other, in a third direction or a fourth direction, said handle is perpendicularly secured to a second end of said second slide with an encircling handle sleeve, either removably or fixedly thereto; and a slide supporting element cap secured about said slide supporting element third end.

2. The pipe clamp according to claim 1, wherein each of said first slide and said second slide have a tubular construction that is cylindrical.

3. The pipe clamp according to claim 2, wherein said first slide has a larger outer diameter and a larger length than said second slide.

4. The pipe clamp according to claim 1, wherein said second clamp has a cuboidal-shape.

5. The pipe clamp according to claim 1, wherein said slide supporting element is generally T-shaped.

6. The pipe clamp according to claim 1, wherein said first clamp body has a predominately rectangular shape.

7. The pipe clamp according to claim 1, wherein said first clamp receiver has a width smaller than an external diameter of said first clamp receiver and a height less than said height of said first clamp body.

8. The pipe clamp according to claim 1, wherein said second clamp is cuboidal-shaped.

9. The pipe clamp according to claim 1, wherein said second clamp body has a height substantially identical to said height of said first clamp.

10. The pipe clamp according to claim 1, wherein said second clamp bore terminates at a distance less than a thickness of said second clamp bore.

11. The pipe clamp according to claim 1, wherein said slide supporting element cap is removably secured about said slide supporting element third end.

12. The pipe clamp according to claim 1, wherein said slide supporting element cap is fixedly secured about said slide supporting element third end.

13. The pipe clamp according to claim 1, wherein said first slide, said second slide, said first clamp, said second clamp, said slide supporting element, said slide retaining element second slide retaining ring, said handle, and said handle sleeve are metal.

14. The pipe clamp according to claim 1, wherein said first slide, said second slide, said first clamp, said second clamp, said slide supporting element, said slide retaining element second slide retaining ring, said handle, and said handle sleeve are rigid plastic.

15. The pipe clamp according to claim 1, wherein said pipe clamp is configured to clamp a plurality of independent pieces by placing said plurality of independent pieces between said first clamp and said second clamp.

16. The pipe clamp according to claim 15, further comprising said second clamp being configured to be forced in said third direction until snug.

17. The pipe clamp according to claim 1, wherein said pipe clamp is configured to spread a plurality of independent pieces by placing a first independent piece outside of said first clamp and a second independent piece on said outside of said second clamp.

18. The pipe clamp according to claim 17, further configured to pull said second slide in a fourth direction until said plurality of independent pieces are biased apart.

19. The pipe clamp according to claim 1, wherein said pipe clamp is configured to apply a force to hold a plurality of objects together and said pipe clamp is configured to force said plurality of objects apart from each other.

* * * * *